US009027379B2

(12) United States Patent
Marti et al.

(10) Patent No.: US 9,027,379 B2
(45) Date of Patent: May 12, 2015

(54) METHOD AND DEVICE FOR THE PRODUCTION OF A STAMPING WITH ENLARGED FUNCTIONAL SURFACE

(75) Inventors: Andreas Marti, Iffwil (CH); Ulrich Schlatter, Lyss (CH)

(73) Assignee: Feintool Intellectual Property AG, Lyss (CH)

( * ) Notice: Subject to any disclaimer, the term of this patent is extended or adjusted under 35 U.S.C. 154(b) by 787 days.

(21) Appl. No.: 12/283,705

(22) Filed: Sep. 15, 2008

(65) Prior Publication Data

US 2009/0173129 A1 Jul. 9, 2009

(30) Foreign Application Priority Data

Sep. 14, 2007 (EP) ..... 07018139

(51) Int. Cl.
*B21D 31/02* (2006.01)
*B21D 28/16* (2006.01)

(52) U.S. Cl.
CPC ..... *B21D 28/16* (2013.01)

(58) Field of Classification Search
CPC ..... B21D 28/16
USPC ..... 72/326–339
See application file for complete search history.

(56) References Cited

U.S. PATENT DOCUMENTS 4,586,360 A * 5/1986 Jurgensmeyer et al. ..... 72/328
5,016,461 A * 5/1991 Walker et al. ..... 72/336

FOREIGN PATENT DOCUMENTS

| | | | |
|---|---|---|---|
| CH | 665367 | | 5/1988 |
| DE | 19738636 | | 3/1999 |
| EP | 1815922 | | 8/2007 |
| JP | 2241624 | * | 9/1990 |

OTHER PUBLICATIONS

Translation of Fujitsu (JP2241624), pp. 1-14.*
2007 "Umformen und Feinschneiden" R.-A. Schmidt et al. Hanser pp. 144-148.

* cited by examiner

*Primary Examiner* — Teresa M Ekiert
(74) *Attorney, Agent, or Firm* — Jordan and Hamburg LLP

(57) ABSTRACT

A method and a device for the production of a stamping with an enlarged functional surface, for example, fine blanking a workpiece out of a flat strip, wherein the flat strip is clamped between an upper part including a shearing punch, a pressure pad for the shearing punch, a V-shaped projection arranged on the pressure pad and an ejector which is pressed into the flat strip, and a lower part including a cutting die and an ejector. Edge rollover is avoided by preforming, before cutting begins, a negative with regard to the cutting direction with a preforming element in the direction opposite to the cutting direction that corresponds to the expected edge rollover into the cutting die with regard to size and geometry at cutting, generating a material volume at the side of the rollover in a mirror-inverted form. During cutting, the preformed area is supported by the preforming element.

14 Claims, 7 Drawing Sheets

METHOD AND DEVICE FOR THE PRODUCTION OF A STAMPING WITH ENLARGED FUNCTIONAL SURFACE

BACKGROUND OF THE INVENTION

The invention relates to a method for the production of a stamping with an enlarged functional surface, especially fine blanking a workpiece out of a flat strip, wherein the flat strip at closing is clamped between an upper part consisting of a shearing punch, a pressure pad for the shearing punch, an arranged on the pressure pad V-shaped projection and an ejector and a lower part consisting of a cutting die and an ejector and the V-shaped projection is pressed into the flat strip.

The invention further relates to devices for the production of a stamping with an enlarged functional surface, especially fine blanking a workpiece out of a flat strip, with a tool having two parts comprising at least a shearing punch, a pressure pad for the shearing punch, an arranged on the pressure pad V-shaped projection, an ejector, a cutting die and an ejector, wherein the flat strip is clamped between pressure pad and cutting die and the V-shaped projection is pressed into the flat strip.

Fine blanking and forming techniques are mainly used to process different steels. Within this, the multiplicity of used materials comprises general-purpose construction steels up to high-tensile fine-grained steels. The resource "material" during the last years gained large importance. With an optimal material utilization, the production costs of a component can be significantly influenced. The high-tensile steels allow for components with thinner walls with the same strength behavior.

In most of the cases, the cutting surface at fine blanking acts as a functional surface, and that is why the rollover is a cost factor.

Typical features of fine blanking parts are the edge rollover and the cutting burr. Especially in corner areas, the rollover occurs, and grows with decreasing corner radius and increasing sheet thickness. The depth of the rollover can be about 30%, and the width of the rollover, about 40% of the sheet thickness or more (see DIN 3345, Feinschneiden, August 1980). Thus the rollover depends on material thickness and quality, so that the possibility to control it is limited and often brings about a limited function of parts, for example, due to a lack of sharp edges of the corners at toothed parts or the caused change in the functional length of the parts.

The stamping rollover thus reduces the functionality of parts and urges the manufacturer to use a thicker raw material.

A number of solutions for trying to get rid of the edge rollover either by re-cutting (CH 665 367 A5), shaving (DE 197 38 636 A1) or shifting of material during the cutting (EP 1 815 922 A1) are known.

The known solutions according to CH 665 367 A5 and DE 197 38 636 A1 do not reduce the edge rollover, but largely rework the parts, so that on the one hand, significant costs for additional machining operations and tools are required and, on the other hand, a respective loss of material occurs due to the necessity of using thicker materials.

In the known solution according to EP 1 815 922 A1, the workpiece is machined in a single-step setup in at least two chronologically successive steps in different cutting directions, wherein during a first cutting process in a vertical working direction, a semi-finished product corresponding to the geometry of the workpiece with small rollover is cut out, and finally cut during at least one further cutting process in the opposite working direction. The rollover of the first partial step with this shall be filled up again at least in the corner area. But with this known method in the first instance, the projecting stamping burr is avoided. Also with this known solution, the rollover lastly is not avoided and material volume is shifted along the cutting line, which is accompanied by an increased risk of tearing.

At this state of the art, it is an object of the invention to largely, systematically avoid the edge rollover by creating a rollover corresponding to the volume within the part geometry, and at the same time, to maintain the functional surfaces at thinner fine blanking parts and to save material, without material being shifted along the cutting line.

SUMMARY OF THE INVENTION

This object is achieved by a method of the above mentioned kind, in accordance with which.

According to the invention, it is possible for the first time to economically apply the fine blanking technique for parts, for example toothed parts of medium and greater thickness, with sharp edges without finishing and material shifting along the cutting line.

This is achieved by carrying out, at the untreated clamped flat strip before the cutting starts, a negative with regard to the cutting direction preforming with a preforming element in the direction opposite to the cutting direction that corresponds to the expected edge rollover into the cutting die with regard to size and geometry at cutting including an allowance and generates a material volume at the side of the rollover in a mirror-inverted form. At the beginning and during the cutting the preformed area of the clamped flat strip is supported by the preforming element.

It is of special advantage that the process parameters for the preforming, for example, the geometry and the material volume of the area to be preformed, are determined depending on the material type, shape and geometry of the workpiece by a virtual forming simulation. This leads to a fast practical design of the preforming elements, especially regarding the preforming angles at the preforming elements.

But the process parameters for the preforming also can be determined iteratively by measuring real fabricated fine blanking parts, without leaving the frame of this invention.

The method according to the invention is variably applicable. So, for instance, the preforming can be carried out in a separate pre-stage as sequential cutting operation within a tool. But it can be also carried out without problems within a complex cutting operation in case the ejector at the same time is used as a preforming element, wherein the complex cutting operation according to the method of this invention is especially advantageous in case of thinner parts.

Thus, the method according to this invention covers fine blanking in a wide range of dimensions, for example, parts up to medium thicknesses and smaller parts up to medium-sized parts in complex cutting operations, and parts up to great thicknesses and dimensions in sequential cutting operations.

The devices according to this invention have a simple and sturdy structure. In case of the application of the sequential cut, at least one coining stamp arranged before the cutting stage acting against the cutting direction is provided to negatively pre-form a material volume on the rollover side corresponding to the expected edge rollover, wherein the coining stamp at its active side has a contour, respectively a preforming angle, which correspond with the geometry of the expected edge rollover plus an allowance.

For the complex cut, at least one stamp acting against the cutting direction is provided, allocated to the cutting stage ejector for negatively preforming a material volume on the rollover side corresponding with the expected rollover, wherein the ejector, at its active side, has a contour, respectively a preforming angle, which corresponds with the geometry of the expected edge rollover plus an allowance, wherein the ejector at cutting supports the preformed area.

The preforming angles for the coining stamp at the sequential cut and the ejector at the complex cut amount to about 20° to 40°.

Further advantages and details accrue from the following description with reference to the attached figures.

The invention in the following will be explained in more detail at the example of an embodiment.

DETAILED DESCRIPTION OF THE INVENTION

Figure 1:
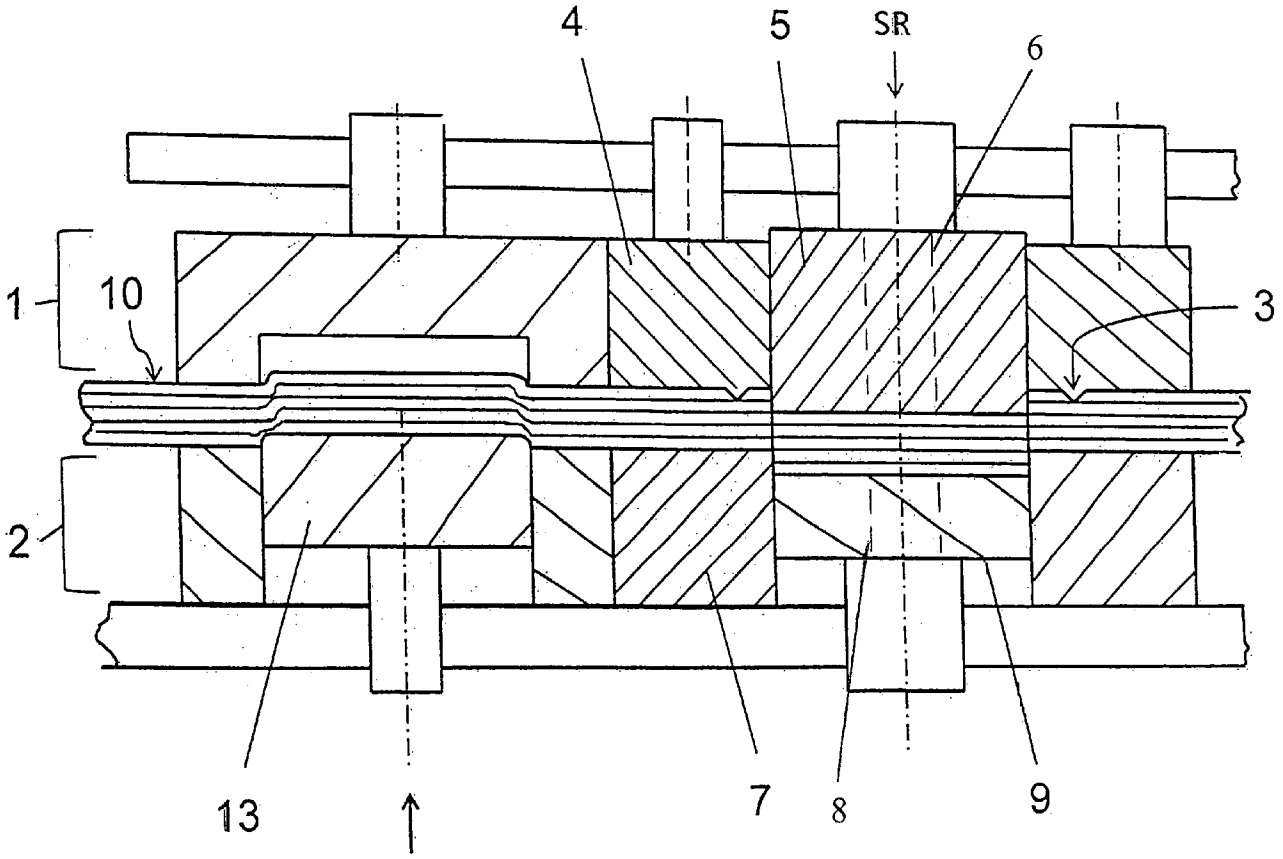
FIG. 1. is a schematic view of the device according to an embodiment of the invention, with a separate pre-stage for preforming the rollover geometry with a flat strip clamped between upper and lower part in the closed tool.
Figure 2:
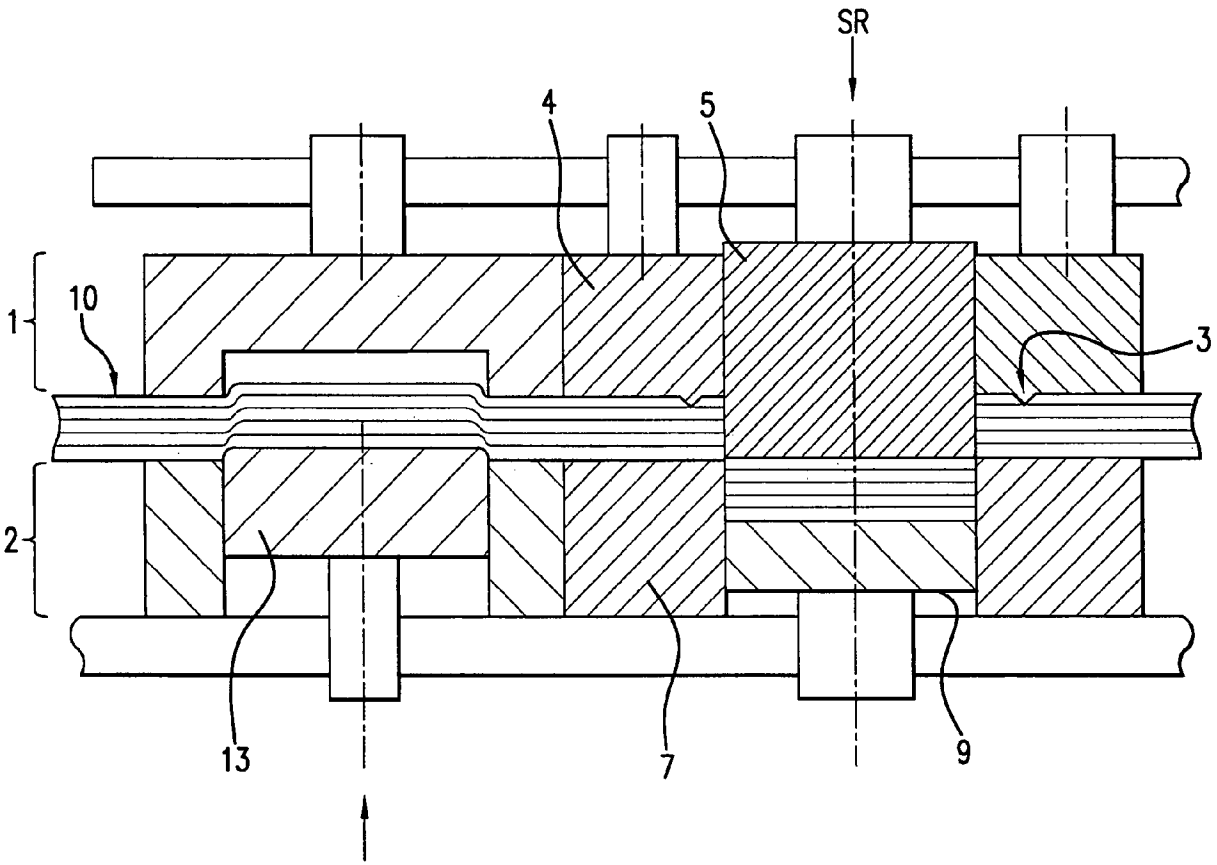
FIG. 2 is a simplified schematic view of the device according to the embodiment of the invention according to FIG. 1 with the flat strip cut through in the closed tool.

FIG. 1 shows the principle structure of the device according to this invention comprising an upper part 1 and a lower part 2. The upper part 1 consists of a pressure pad 4 with a V-shaped projection 3, a shearing punch 5 guided in the pressure pad 4 and an ejector 6. The lower part 2 consists of a cutting die 7, an inner form punch 8, and an ejector 9. The flat strip 10 of alloyed stainless steel with a thickness of 4.5 mm, out of which, according to the method of this invention, shall be fabricated a driving gear 11 with toothing 12. According to the shown state of the tool, the flat strip 10 is clamped between pressure pad 4 and cutting die 7, and the V-shaped projection 3 has already penetrated the flat strip 10, whereby due to the applied force of the V-shaped projection, the material is prevented from continued flow during cutting.

Figure 3:
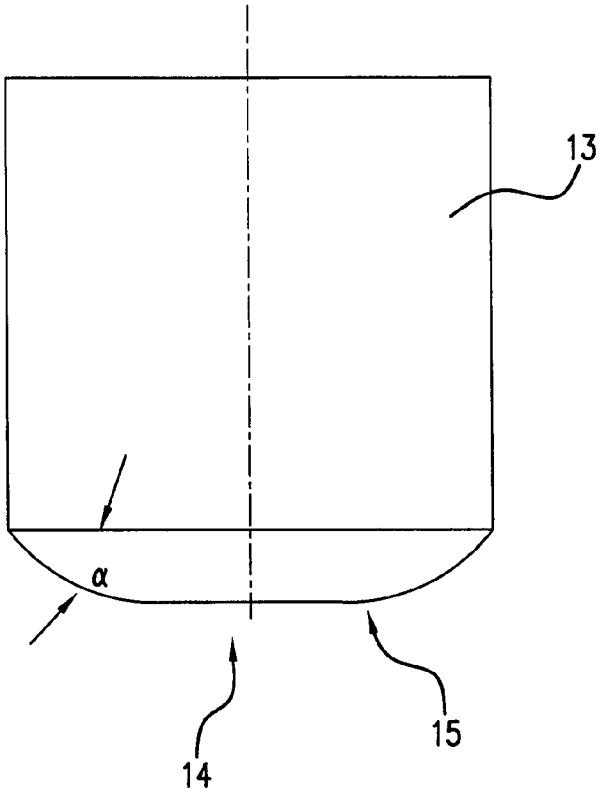
FIG. 3 is an enlarged view of the coining stamp with a preforming angle.

The pre-stage is formed by a guided in the lower part 2 designed as preforming element V coining stamp 13, which on its active side 14, has a previously determined preforming angle α and a contour 15 (in a virtual forming simulation), corresponding to the geometry of the expected rollover plus an allowance resulting from experimental values (see FIG. 3). The preforming of the flat strip clamped between upper part 1 and lower part 2 is carried out by the coining stamp 13 working against the cutting direction SR of shearing punch 5. The coining stamp 13, during its forward movement, deforms the flat strip 10, wherein the contour 15 of the active side 14 of the coining stamp with its preforming angle α penetrates into the material of the flat strip until a value adjusted to the geometry of the rollover is reached and causes a deformation of the flat strip 10 corresponding to the expected volume of the rollover.

FIG. 3 shows an example of a coining stamp 13 with a respective contour 15 on its active side. It can be seen that this contour exactly corresponds with the geometry of the rollover.

The process parameters for the preforming, for example the geometry, i.e., the height of the rollover and the width of the rollover, and the material volume, i.e., the volume of the rollover, are determined depending on the type of material, shape and geometry of the workpiece by a virtual forming simulation, wherein the material flow in the forming process is shown, extensions and reference stress values are analyzed to find out whether the forming can be realized and the tool elements can bear the loads. But the process parameters can be also determined at the real fine blanking part by individually measuring the height of the rollover, the width of the rollover and determining the volume of the rollover. That requires a series of tests and their analysis to be able to respectively design on this basis the coining stamp 13.

Instead of the separate pre-stage, here described in more detail it is possible of course to use the ejector 9 as preforming element for preforming of the clamped flat strip according to the expected geometry of the edge rollover.

The interrelationships to assist in an understanding of the method according to this invention are shown in the FIG. 4*a*, 4*b*, 5 and 6.

Figure 4A:
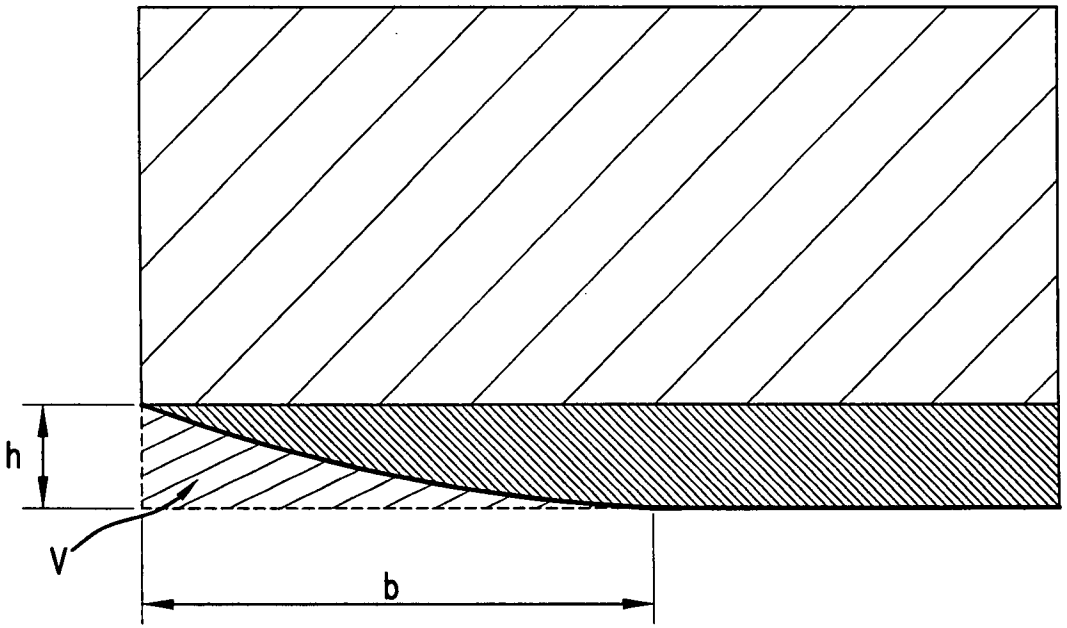
FIGS. 4*a* and 4*b* each is respectively a schematic view of the geometry of the edge rollover according to the state of the art and according to the preforming according to the invention.

FIG. 4*a* shows the occurring rollover at a fine blanking part fabricated without applying the invention. This rollover E according to DIN 6930 and VDI guide lines 2906 is defined by the edge rollover height h and the edge rollover width b and the occurring burr by the cutting burr height and the cutting burr width. It is secured knowledge that the burr volume with respect to the rollover volume V is many times smaller. So to speak, volume has been lost. This volume on the one hand clearly moves behind the outer contour of the part and on the other hand a small amount is lost because of the strain hardening of the material.

During shearing, applied tensile forces to the material are present which increase beyond the cohering forces in the atomic lattice. This leads to a slip between the adjoining planes of shearing punch 5 and cutting die 7. But before the real shearing, plastic deformations occur, leading to the edge rollover E.

For each geometry of a part to be fabricated according to the method of this invention, the dimensions and the volume V of the expected edge rollover are determined. This can be done either by forming simulation or direct measuring of real parts.

Figure 4B:
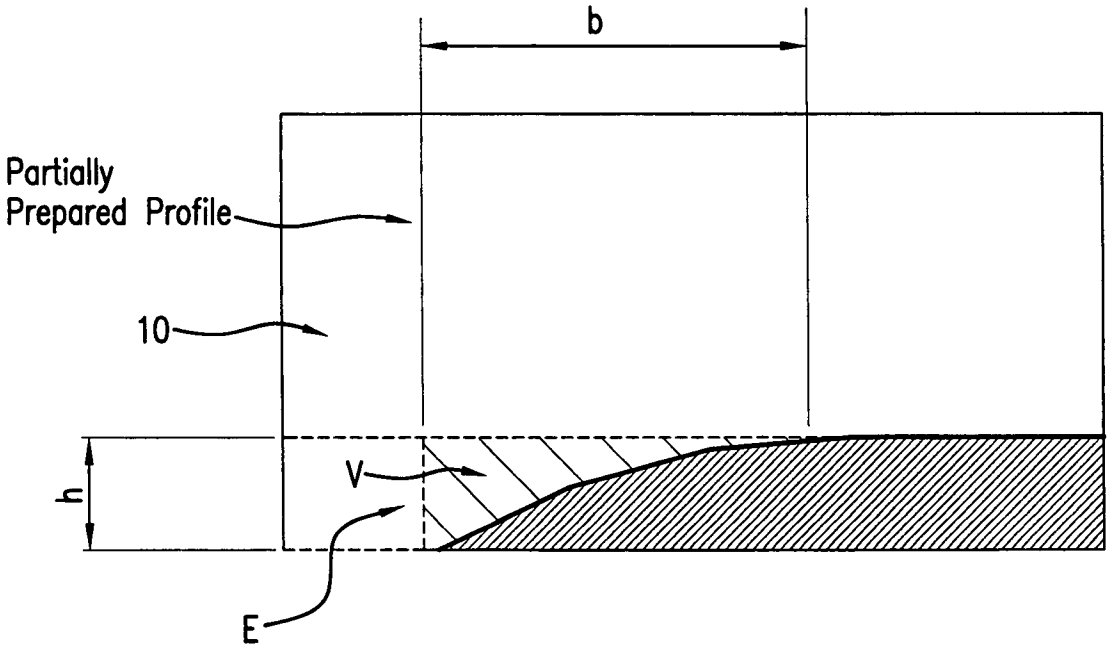

In FIG. 4*b* is schematically illustrated that the so determined edge rollover E is represented in the opposite direction on the rollover side in mirror-inverted form. This is realized by a respective preforming with the coining stamp 13 having a adjusted to the geometric circumstances of the expected edge rollover E contour 15 with preforming angle α.

Figure 5:
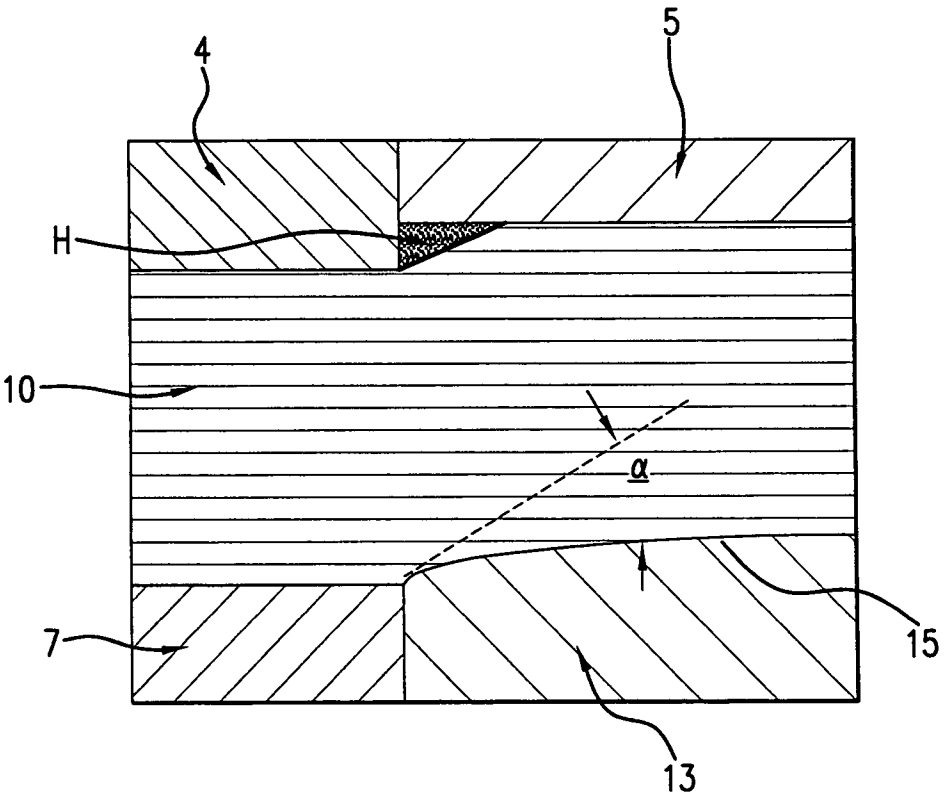
FIG. 5 is a schematic view of the coordination between coining stamp and the preformed area of the flat strip.

FIG. 5 shows the particularly good coordination between the contour 15 at the coining stamp 13 and the preformed area of the flat strip 10. Whereas the preformed area on the ejector side is supported by the contour 15 at coining stamp 13 on the guided side occurs a hollow space because the shearing punch 5 stands back by the rollover height h. The result of this coordination is a hollow space H, which nevertheless can not be filled up completely due to the significantly smaller volume of the burr compared to the volume of the rollover. Due to the lateral limitation caused by cutting die 4, the material can not get away and is respectively formed, which leads to an additional hardening of the inflow-zone in the area of rollover E.

Figure 6:
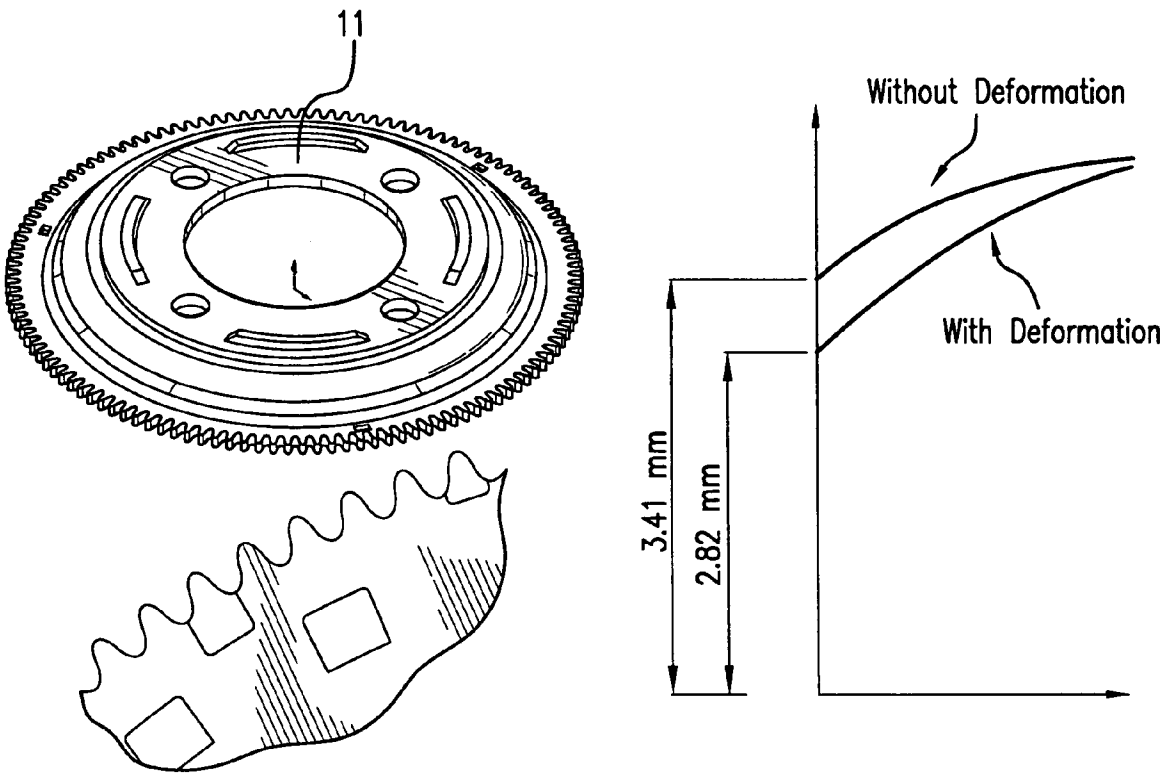
FIG. 6 is an example of a driving gear produced according to the method of the invention with and without preforming.

FIG. 6 shows the example of a driving gear 11 fabricated according to the method of this invention at which was reached a measured at the tip of the tooth reduction of the rollover of 36%.

LIST OF REFERENCE SIGNS upper part of the fine blanking tool 1
lower part of the fine blanking tool 2
V-shaped projection 3
Pressure pad 4
Shearing punch 5
ejector 6
cutting die (die-plate) 7
ejector 9
flat strip 10
drive gear 11
toothing 12
coining stamp/ejector 13
active side of 13 14
contour of 13 15
edge rollover E
edge rollover width b
edge rollover height h
hollow space H
cutting direction SR
rollover volume V
preforming angle α

The invention claimed is:

1. A method of avoiding rollover of an edge during a fine blanking process for producing a stamping out of a flat strip using a fine blanking tool, comprising:

predicting an edge rollover for a flat strip of known material and geometry, said predicted edge rollover comprising rollover height, width, volume and location values relative to said flat strip in a vicinity of a known cutting line, said predicted edge rollover being determined for a case in which rollover compensation is absent;

configuring a geometry of a preforming element so as to correspond to a mirror-inverted form of the predicted edge rollover;

clamping the flat strip between an upper part of the fine blanking tool, including a shearing punch, a pressure pad for the shearing punch, and a V-shaped projection arranged on the pressure pad and an ejector, and a lower part of the fine blanking tool, including a cutting die and the preforming element;

preforming an impression in the flat strip to compensate for said predicted edge rollover by advancing the preforming element in a direction opposite to a cutting direction of the shearing punch to achieve a preformed area of the flat strip;

cutting with said shearing punch the flat strip along said known cutting line in the cutting direction to achieve said produced stamping, said produced stamping that is achieved by said cutting being absent of said predicted edge rollover; and supporting the preformed area of the flat strip by the preforming element at a start of, and during, said cutting; and wherein the impression corresponds to said predicted edge rollover, and said preforming the impression is by pushing material into an area in said vicinity of the known cutting line of said cutting, so that said preformed area compensates against formation of the predicted edge rollover during said cutting in the cutting direction and so as to achieve said absence of said predicted edge rollover for said produced stamping.

2. A method according to claim 1, wherein said predicted edge rollover comprises performing a virtual forming simulation that results in process parameters for use during the preforming in the preformed area and is based on a material type, shape and geometry of the flat strip.

3. A method according to claim 2, wherein said process parameters provide an estimation of the geometry and/or the material volume of the predicted edge rollover.

4. A method according to claim 1, wherein said cutting is a run time cutting and wherein said predicted edge rollover comprises, prior to said run time cutting:

iteratively performing trial cuttings into either one or both of the flat strip or another flat strip of same material type, shape and geometry as said flat strip from which the stamping is produced;

measuring geometry of edge rollover from the trial cuttings to determine said height, width, volume and location values of predicted edge rollover; and determining process parameters from said predicted edge rollover for use during the preforming to compensate for said predicted edge rollover.

5. A method according to claim 1, wherein the preforming is carried out in a separate pre-stage or before starting the cutting in a common stage, process parameters of which are respectively adjusted according to said predicted edge rollover to compensate for said predicted edge rollover during said cutting.

6. A method according to claim 5, wherein the preforming and the cutting performed subsequently are used in production of parts with a thickness of no greater than 10 mm.

7. A method according to claim 6, wherein said thickness is 3 to 5 mm.

8. A method according to claim 5, wherein the preforming and the cutting are used in production of parts with a thickness of 3 to 7 mm.

9. A method according to claim 1, wherein said preforming element includes a coining stamp.

10. A method according to claim 1, wherein said preforming element is used as the ejector of the fine blanking tool.

11. A method according to claim 1, wherein the fine blanking process results in no material being shifted along a cutting line determined by the cutting die and the punch.

12. A fine blanking device and a flat strip, the fine blanking device being adapted to avoid a predetermined edge rollover in a vicinity of a known cutting line during a cutting operation in a cutting direction of a fine blanking process for producing a stamping out of the flat strip of a known material type and thickness so as to achieve an enlarged functional surface out of the flat strip, the predetermined edge rollover being predetermined based on a geometry of the flat strip and having a predetermined height, width, volume and location value with respect to said flat strip, the adapted fine blanking device comprising:

an upper part including a pressure pad with a V-shaped projection, and a shearing punch guided in the pressure pad; and a lower part including a cutting die and an ejector, the flat strip being clamped between the upper part and the lower part during operation of the device wherein the flat strip is positioned between the pressure pad and cutting die and the V-shaped projection is pressed into the flat strip, said lower part further including at least one coining stamp arranged before a cutting stage;

wherein said coining stamp is preconfigured to have a geometry corresponding to a mirror-inverted form of the predetermined edge rollover;

wherein said coining stamp is configured to be positioned in a vicinity of the known cutting line of the shearing punch during said fine blanking process;

wherein said coining stamp is configured to act against the cutting direction of the shearing punch to form an impression, corresponding to said predetermined edge rollover, as a preformed area in the flat strip in said vicinity of the known cutting line, said impression compensating for said predetermined edge rollover in the vicinity of the known cutting line during said cutting operation so as to avoid occurrence of said predetermined edge rollover in the produced stamping.

13. A device according to claim 12, wherein the coining stamp geometry and the ejector each comprises a preforming angle of 20° to 40°.

14. A device according to claim 12, wherein the coining stamp geometry and the ejector each comprises a preforming angle of 30°.

* * * * *